US006419576B1

(12) United States Patent
Han

(10) Patent No.: US 6,419,576 B1
(45) Date of Patent: Jul. 16, 2002

(54) SOUND ATTENUATING INLET SILENCER FOR AIR SUPPLYING FAN

(75) Inventor: Ming Hui Han, Mississauga (CA)

(73) Assignee: Air Handling Engineering Ltd.

( * ) Notice: Subject to any disclaimer, the term of this patent is extended or adjusted under 35 U.S.C. 154(b) by 0 days.

(21) Appl. No.: 09/817,739

(22) Filed: Mar. 22, 2001

(51) Int. Cl.[7] ..... F24F 7/007

(52) U.S. Cl. ..... 454/338; 454/906; 181/224; 181/225

(58) Field of Search ..... 454/906, 262, 454/338; 181/224, 225, 256, 268

(56) References Cited

U.S. PATENT DOCUMENTS 4,186,819 A * 2/1980 Nowak et al. ..... 181/265
5,099,566 A * 3/1992 Barrett ..... 29/451

* cited by examiner

*Primary Examiner*—Harold Joyce
*Assistant Examiner*—Derek S. Boles

(74) *Attorney, Agent, or Firm*—Young & Basile

(57) ABSTRACT

An air duct silencer can be used at the inlet of an air supply fan unit for a building or other large structure. The silencer has an exterior housing with exterior walls forming outer surfaces of the housing and interior walls arranged in the housing, connected to the exterior walls and defining an annular airflow passageway extending between an air inlet located at one end and a circular air outlet adapted for connection to the fan unit. The outlet defines a primary central axis extending through the center of the outlet and perpendicular to a plane in which the outlet lies. A central airflow defining member has a second central axis extending from an outer end thereof to an inner end and this axis is substantially coaxial with the primary central axis. This airflow defining member is substantially circular in transverse cross-section along its length and has a relatively wide bulb like end section at its outer end and a narrow end section at the inner end. There is sound absorbing material in the housing which is covered by the interior walls and also in the airflow defining member. The transverse cross-section of the airflow defining member causes the air velocity to be substantially higher at the air outlet than at the inlet.

15 Claims, 4 Drawing Sheets

SOUND ATTENUATING INLET SILENCER FOR AIR SUPPLYING FAN

BACKGROUND OF THE INVENTION

This invention relates to air duct silencing apparatus for connection to the intake of an air supply fan unit for a building or other large structure.

Air duct silencers of various types are well known in the air handling industry. A number of these silencers are designed for attachment either to the inlet or the outlet of an air supply fan which is capable of creating substantial noise during its operation. One purpose of these silencers is to prevent noise from the fan from passing through the air duct system of the building and thereby disturbing people who may be dwelling or working in the building. It is important that these air duct silencers not only be capable of reducing the level of noise from the fan substantially but also that they accomplish this objective efficiently so that the necessary air supply can still be delivered by the fan unit to various areas in the building. It will be appreciated that if the air duct silencers are not very efficient, it may be necessary to increase the size of the fan unit in order to deliver the quantity of fresh and/or return air required by the building. As larger fans require more electrical energy in order to operate, it is generally desirable not to increase the size of the fan unit any more than necessary.

In the case of an inlet silencer for a fan unit, it is desirable to have the velocity of the airflow entering the inlet of the silencer relatively low as this results in a velocity variant between heat exchanger coils, which are often located a short distance upstream of the inlet silencer, and the unit of the silencer being small. As a result, there will be achieved relative uniformity of airflow velocity across the face of the heat exchanger coils despite the short distance between the adjacent face of these coils and the inlet of the silencer. Other desirable objectives of an air handling silencer are the existence of a low pressure drop across the silencer and the lack of upstream wakes or flow distortion created by splitters or similar air attenuating devices in the airflow passage.

Other desirable objectives that are often sought in the design and construction of air inlet or air outlet silencers include the provision of a compact silencer since often the amount of available space for these silencers is quite limited and the use of a silencer design which requires fewer materials and less labor to build, thus reducing overall costs.

One known type of inlet silencer for a fan unit is that manufactured and sold by M & I Heat Transfer Products Ltd. of Mississauga, Ontario, Canada, and disclosed in its Compac Space Fan System brochure. In this inlet silencer, which is generally designed to sit on the floor below the fan unit, there is an annular air inlet that can be open on four vertical sides of the air inlet apparatus and an annular air outlet in the top of the housing that forms the air inlet silencer. Located in the centre of the housing is a substantially conical airflow defining member with a wide circular base and a narrow circular top adjacent the inlet of the fan. There are curved, perforated interior walls that form an outer section of the air inlet silencer and that surround the inner airflow defining member. The inner airflow defining member is filled with sound attenuating material and similar material is also located behind the interior walls of the outer section.

German Offenlegungsschrift 3401 210 A, describes a silencer that can be mounted either at the entrance to or the exit from an axial fan unit. This silencer also has an exterior housing that contains sound-absorbent material and an annular duct extends from one end of this housing to the opposite end. This silencer has a central airflow defining member that has first and second longitudinal sections with the first longitudinal section having a generally conical shape and the second, shorter section being cylindrical. The outer end of the airflow defining member is quite wide with the outer end surface being planar and extending transversely to a longitudinal central axis of the airflow defining member. In this air duct silencer, the cross-sectional flow area of the annular duct is indicated to be constant over the entire length of the silencer and may be equal to or slightly greater than that of the annular passage forming the fan inlet. The airflow defining member in this silencer is filled with sound-absorbent material.

Recent U.S. Pat. No. 5,426,268 issued Jun. 20, 1995 to M Yazici et al describes both an inlet silencer and an outlet silencer for an axial fan unit. The duct inlet apparatus described in this patent, which apparatus can also be used for an outlet silencer, includes an exterior housing with two principal air inlets located on opposite vertical sides of the housing. The silencer has a single annular air outlet located at one end of the housing and this outlet is connected to the inlets by main airflow passageways defined by interior walls that are preferably perforated. Sound insulating material can be placed behind the interior walls. Preferably each inlet is divided into four generally rectangular segments of similar size. It will be appreciated that this inlet silencer is reasonably complex and can be time consuming to construct.

It is an object of the present invention to provide an air duct silencing apparatus wherein the velocity of airflow entering the inlet of the apparatus can be relatively low and wherein the pressure drop across the length of the apparatus is reasonably low.

It is a further object of the present invention to provide an air duct silencing apparatus that is reasonably compact and that can be constructed at a reasonable cost while at the same time providing good sound attenuating characteristics.

It is a further object of the present invention to provide substantially uniform inlet flow to a fan's blades so that the fan is able to achieve high performance in terms of both aerodynamics and acoustics.

SUMMARY OF THE INVENTION

According to one aspect of the invention, an air duct silencing apparatus for use as an inlet silencing duct to be connected to an air supply unit for a building or other large structure includes an exterior housing having exterior walls forming outer surfaces of the housing, an air inlet formed on one end of the housing and a circular air outlet formed in an opposite end of the housing and adapted for connection to the fan unit for airflow to the fan unit. The outlet defines a primary central axis extending through the center of the outlet and perpendicular to a plane in which the outlet lies. Interior walls are arranged in the housing and are connected to the exterior walls. These interior walls define an annular airflow passageway extending from the air inlet to the air outlet and a substantial portion of these walls are made of perforated metal. There is also a central airflow defining member having a second central axis extending from an outer end thereof to an inner end adjacent the air outlet. This second central axis is substantially coaxial with the primary central axis. The airflow defining member is substantially circular in transverse cross-section along its length and has a relatively wide bulbiform end section at its outer end. The airflow defining member also has a relatively narrow end section at its inner end. Sound absorbing material is provided in the housing and is covered by the interior walls and is also located in the airflow defining member. The airflow passageway tapers inwardly in the direction of the air outlet and the cross-sectional flow area of this passageway varies along at least a substantial portion of its length so that airflow speed at the air inlet is low relative to airflow speed at the air outlet when the air duct silencing apparatus is connected to the fan unit and the fan unit is operating.

In a preferred embodiment, the central airflow defining member projects outwardly from the air inlet. Also, the airflow passageway is tapered and the airflow defining member is curved as seen in an axial plane extending through the second central axis so that the airflow speed increases smoothly to maximum velocity at the air outlet when the fan unit is operating.

According to another aspect of the invention, there is provided an air duct silencing apparatus adapted to be connected to an air supply fan unit, this apparatus having a housing with two opposite end walls, an air inlet formed in one of these end walls, and a smaller air outlet formed in the other end wall where the fan unit is located during use of the silencing apparatus. Interior walls are arranged in the housing and define an annular, tapered airflow passageway extending from the air inlet to the air outlet. The apparatus is provided with an improved airflow defining member located centrally in the airflow passageway and extending the length of the airflow passageway. This member has a substantially circular transverse cross-section and has first and second longitudinal sections, with the first longitudinal section being relatively wide with side walls that are curved along the length of the section in axial planes extending through a central longitudinal axis of the member. The second longitudinal section is relatively narrow and cylindrical and located adjacent the air outlet. The cross-sectional flow area of the annular airflow passageway varies along its length so that the airflow speed at the air inlet is low relative to airflow speed at the air outlet during use of the silencing apparatus.

Preferably, the first longitudinal section is substantially bulb-shaped and the airflow defining member is filled with sound insulating material.

Further features and advantages of the air duct silencing apparatus of the invention will become apparent from the following detail description taken in conjunction with the accompanying drawings.

DETAILED DESCRIPTION OF PREFERRED EMBODIMENT

Figure 1:
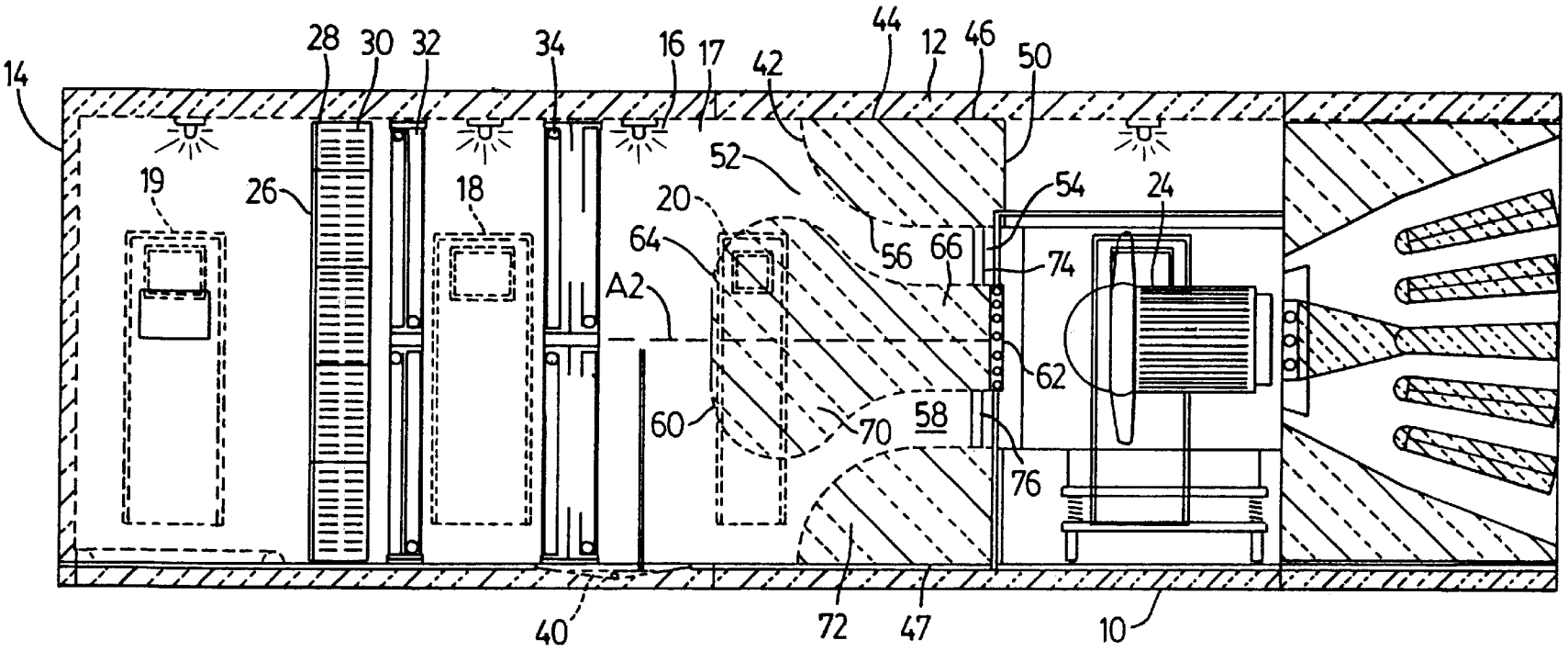
FIG. 1 is a sectional elevation illustrating an air handling system employing an air duct inlet silencer apparatus constructed in accordance with the invention.

FIG. 1 illustrates a layout of an air handling unit that employs an axial fan and an air duct inlet silencer constructed in accordance with the invention. The right hand end of this air handling system has been omitted from both of FIGS. 1 and 2 as it can be of standard construction and forms no part of the present invention.

The illustrated unit has a horizontal floor 10, a ceiling 12 and vertical walls including an end wall 14. It will be understood that the inner space 16 for this air handling system is completely enclosed by wails but access to the inside can be gained by one or more access doors such as the two doors 18 and 20. The doors 18 and 20, although shown in FIG. 1, are located in fact on vertical side wall 22 located on the right side wall of the unit. There can be a further door 19 located in the left hand wall that provides access to the air intake area of the unit. The walls of this unit, including the ceiling 12, can be covered with suitable sound absorbing material in a well known manner, if desired.

There is often located in the air handling unit a bank of filters indicated generally at 26 and this bank extends substantially across the width of the unit and for the full height of the unit so that all air must pass through the filters. The bank of filters can include a two inch layer of prefilter 28 and a much thicker layer of secondary filter 30 which may, for example, be twelve inches thick. Downstream of the illustrated filter bank are two heat exchanging systems, one for heating located at 32 and another for cooling located at 34. These heat exchanging systems can be of standard coil construction and access to these heat exchanging coils can be gained through the wall 22 by means of removable panels 36, 37, illustrated in FIG. 2. If desired, there can also be a final, high capacity filter located downstream of a fan unit 24, this filter not being shown in the drawings. Preferably there is a stainless steel drain pan 40 provided beneath the cooling coil 34.

Located a relatively short distance downstream of the cooling coils 34 is an air duct silencing apparatus indicated generally at 42. This apparatus is for use as an inlet silencing duct which can be connected to the air supply fan unit 24, which supplies suitable conditioned air to the building or other large structure. This silencing apparatus or inlet flow concentrator 42 includes an exterior housing 44 having exterior walls including a top wall at 46, a bottom wall at 47 and two vertical side walls 48 and 49. The housing can also include a sheet metal end wall at 50. These walls can be made of solid, non-perforated sheet metal and it will be understood that this exterior housing together with the remainder of the air duct silencing apparatus of the invention can be manufactured in a manufacturing plant and then shipped to the building or other structure in which it is to be used. Further details of the construction of the exterior housing herein are deemed unnecessary as such housings for use as the exterior of an air duct silencer are well known in the art. An air inlet 52 is formed in one end 53 of the housing and the preferred air inlet is annular as shown. Formed in an opposite end 55 of the housing is an annular and circular air outlet 54, this outlet being adapted for connection to the fan unit 24 for airflow to the fan unit. The outlet defines a primary central axis A that extends through the center of the outlet and is perpendicular to a transverse plan in which the outlet lies, this central axis being indicated in FIG. 3.

The air duct silencing apparatus 42 also includes interior walls arranged in the housing, these walls being indicated at 56. These interior walls are connected to the aforementioned exterior walls and they define an annular airflow passageway 58 extending from the air inlet 52 to the air outlet 54. At least a substantial portion of the annular, curved interior walls 56 are made of perforated sheet metal, the use of which in air duct silencers is per se well known in the air handling industry. In the illustrated preferred embodiment, all of the interior walls are made of this perforated sheet metal.

Figure 2:
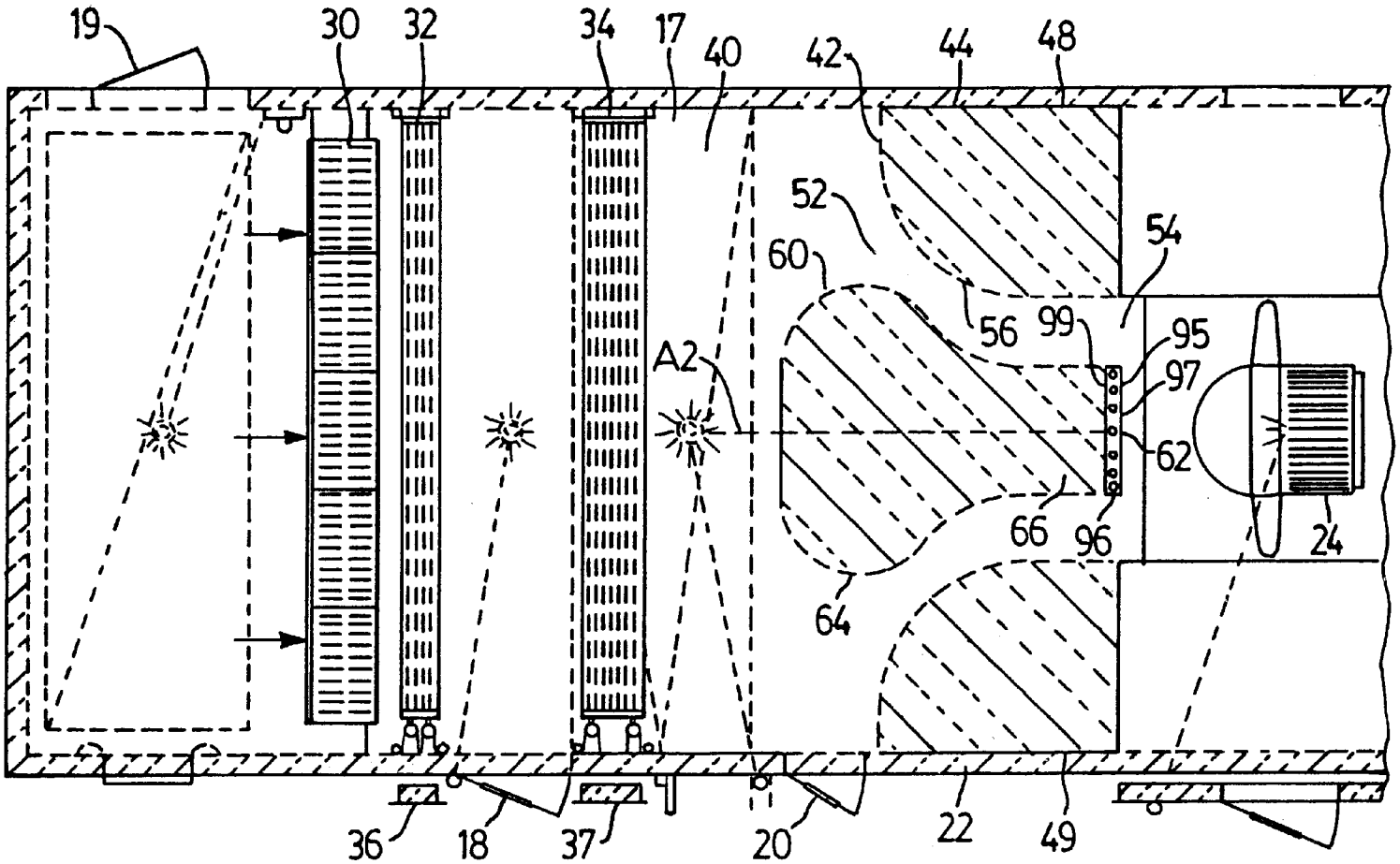
FIG. 2 is a horizontal cross-section of the air handling system of FIG. 1, this view omitting the air outlet silencer shown in FIG. 1.

The silencing apparatus also includes a central airflow defining member indicated generally at 60, this member having a central axis indicated at A2 (hereinafter sometimes referred to as a second central axis) in FIGS. 1 and 2. This central axis extends from an outer end of the airflow defining member to an inner end 62 adjacent the air outlet of the inlet silencer. It will be appreciated that this second central axis is substantially coaxial with the primary central axis A. The airflow defining member 60 is substantially circular in transverse cross-section along its length and it has a relatively wide, bulbiform or bulb-like end section 64 at the outer end. The airflow defining member also has a relatively narrow end section 66 at its inner end. At least a substantial portion of the exterior of this airflow defining member is made of perforated sheet metal which can be similar to that used to form the interior walls 56. The preferred airflow defining member is filled with sound absorbing material 70. Also sound absorbing material 72 is located in the exterior housing between the interior walls 56 and the exterior walls.

The preferred airflow passageway 58 curves or tapers inwardly in the direction of the air outlet 54 and the cross-sectional flow area of the annular airflow passageway varies along its length as illustrated so that airflow speed at the air inlet 52 is low relative to airflow speed within the silencing apparatus and at the air outlet 54 when the silencing apparatus 42 is connected to the fan unit 24 and the fan unit is operating. It will be understood that suitable rigid metal struts or braces are used to mount the airflow defining manner in the indicated central position. These struts are arranged and located so that they do not interfere unduly with the airflow through the airflow passageway. A couple of these struts are indicated at 74 and 76 in FIG. 1. There can be struts both at the forward end and at the rearward end of the airflow defining member.

Figure 3:
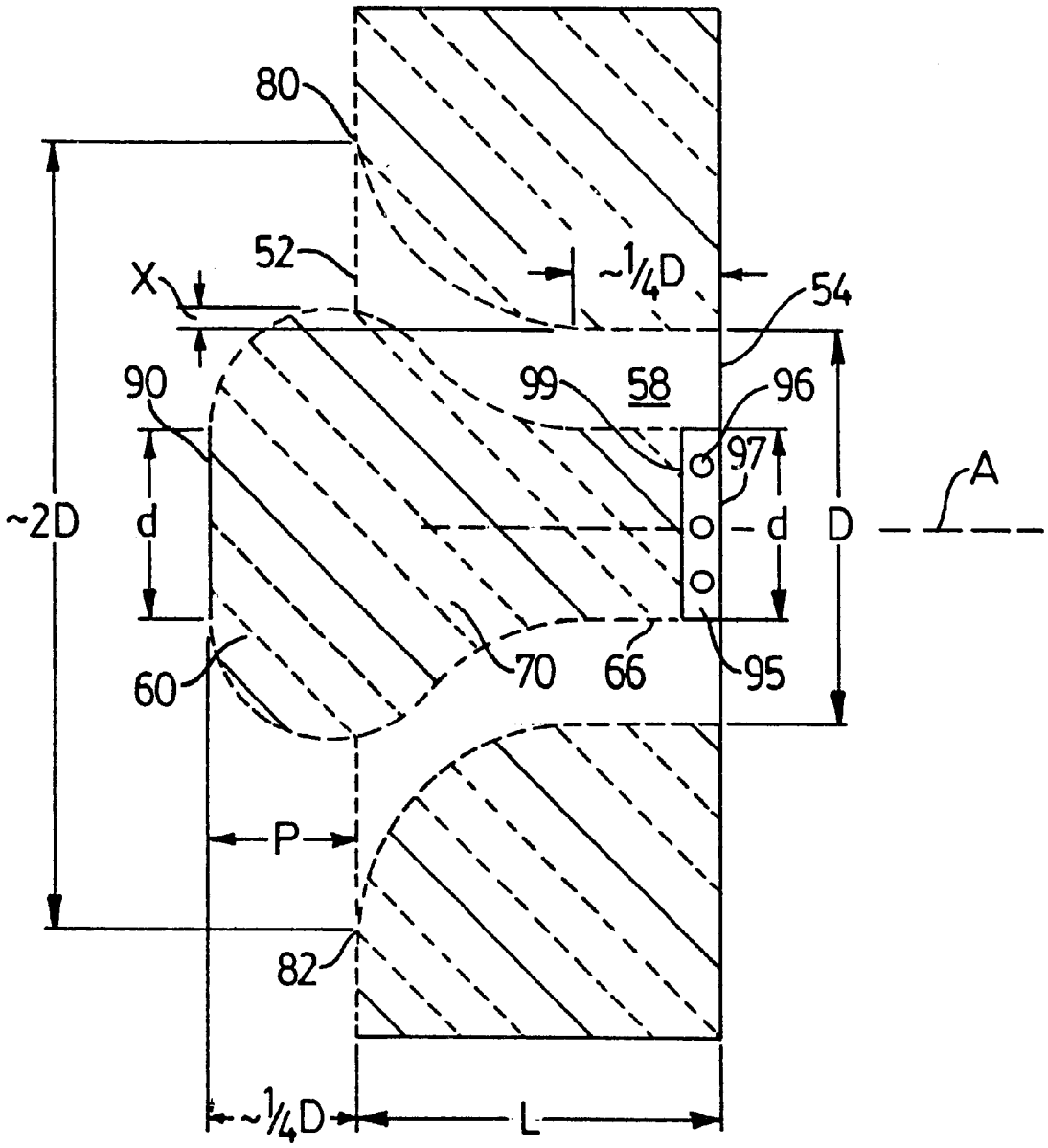
FIG. 3 is a schematic axial cross section of an air inlet silencer constructed in accordance with the invention, this view illustrating certain significant dimensions of the silencer.

In the preferred embodiment of this silencing apparatus, the central airflow defining member 60 projects outwardly from the air inlet as illustrated. The extent of this projection in the preferred embodiment is illustrated in FIG. 3. The diameter of the airflow passageway 58 is represented by D in this figure and the diameter of the air inlet 52 at the commencement points 80 and 82 for the curved interior walls is approximately 2D. In the same preferred embodiment, the extent of the projection indicated by P is equal to about ¼D. In one particular preferred embodiment employing this relationship, the length of the exterior housing indicated by L is approximately 54" but this length can be shorter depending on fan dimensions and sound specifications.

Preferably the airflow passageway is so tapered and the air defining member is curved as seen in axial planes extending through the second central axis A2 so that the airflow speed increases smoothly to maximum velocity at the air outlet 54 when the fan unit is operating. It will be further noted that in the preferred embodiment, the narrow end section 66 is cylindrical and has a uniform diameter represented by d in FIG. 3. The dimension "d" is selected to match (or be slightly smaller than) the fan hub diameter. In this way, the air is channeled directly to the annular fan blade passageway which improves fan performance. The preferred outer end 90 of the airflow defining member is flat and circular and extends in a transverse direction, that is perpendicular to the second axis A2. This outer end 90 in one preferred embodiment has a diameter d equal to the diameter of the narrow end section 66. Preferably the outer end portion having the diameter d is made of solid, non-perforated sheet metal.

The preferred airflow defining member 60 can be defined in terms of having first and second longitudinal sections, the first section being represented by the bulbiform end section 64 with the second section being formed by the narrow end section 66. It will be appreciated that the first longitudinal section at 64 is relatively wide with perforated side walls that are curved along the length of the section in axial planes extending through the central longitudinal axis A2 of the airflow defining member. As illustrated, in FIG. 3, the first longitudinal section at 64 has a maximum diameter which is slightly more than the diameter D of the air outlet. The difference in the radius of the end section 64 at its maximum diameter compared to the radius of the end section 66 is indicated by X in FIG. 3. In one preferred embodiment, the distance X is approximately one inch. It will be appreciated that because of this difference in the respective diameters of the end section 64 and the air outlet, there is very little, if any, direct line of sight between the rotating blades of the fan unit and an air chamber 17 located upstream of the inlet flow concentrator 42. It is preferred that a direct line of site be avoided in order to prevent the direct passage of sound waves from the rotating fan blades. Another relative dimension that is illustrated in FIG. 3 is the relative length of the second longitudinal section, that is the narrow end section 66. This section has a length equal to approximately ¼ D with D being the diameter of the air outlet. It will thus be seen that the length of this second longitudinal section is approximately equal to the distance P by which the airflow defining member 60 projects outwardly from the air inlet 52, this projection being in a direction away from the air outlet 54.

An optional preferred feature that is illustrated in the drawings is a sound attenuating resonator 95 located at the air outlet 54. This resonator, which per se is of known construction, includes a hollow chamber surrounded by a short cylindrical side wall having a plurality of holes 96 formed therein and circular end walls at 97 and 99. The hollow chamber of the resonator has a diameter equal to approximately that of the narrow end of the inlet silencer. The peripheral wall that contains the holes 96 faces the airflow passageway. In one preferred embodiment the chamber walls are made of 16 gauge sheet metal and are imperforate except for the aforementioned holes 96. The holes, which can measure 1 inch in diameter, are spaced evenly about the circumference of the chamber. This resonator 95 in a manner known per se provides means for changing the acoustic impedance of the air supply stream and the resonator chamber acts as an additional noise control element.

Using a known formula which is set out in U.S. Pat. No. 5,587,563, the disclosure of which is incorporated herein by reference, one can obtain the necessary information for calculating the details of the resonator chamber useful in a particular air supply duct system. These details include volume, throat diameter and acoustic resistance. It will be appreciated that the size and arrangement of the resonator chamber to be used and the number of holes in the peripheral wall will vary depending upon the frequency of the noise created by the fan unit which is to be reduced. Thus the resonator can be tuned to the blade passage frequency of the fan and can thus take out peak pure tone sound.

Figure 4:
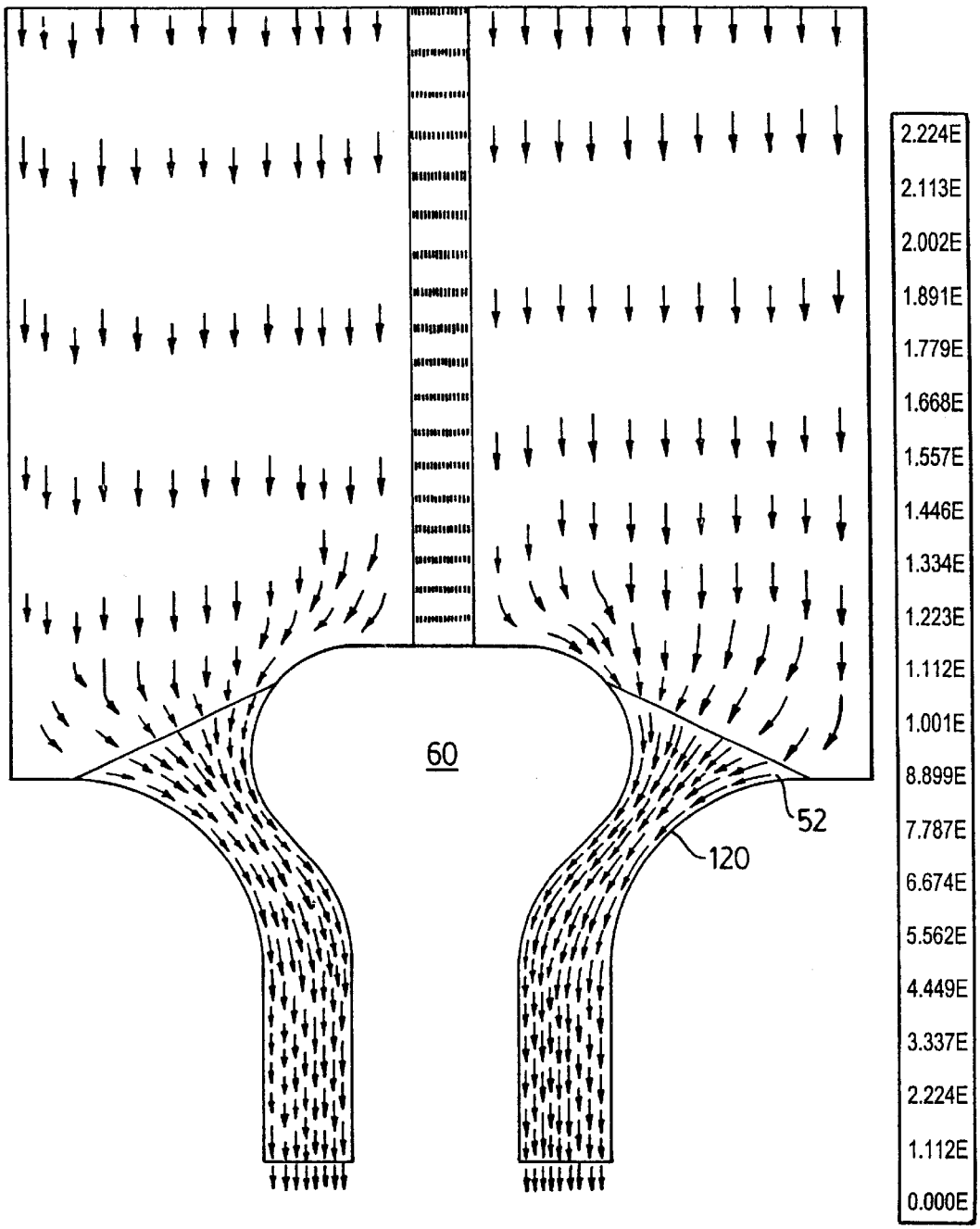
FIG. 4 is a schematic illustration showing the airflow as it approaches the air inlet of the silencer and as it passes through the airflow passageway with the airflow speed at a number of locations along the airflow path being indicated on the right side.

FIG. 4 illustrates using air velocity vectors how the incoming airflow approaches the inlet silencer of the invention and then passes through the airflow passageway of the silencer to the fan unit. It will be seen from this drawing that in the large airflow passageway located upstream of the airflow defining member at 60, the airflow is relatively uniform across the width and height of the passageway at a very short distance upstream. As air enters into passageway 58, the air velocity increases substantially until reaching its maximum velocity at the outlet of the silencer (i.e. the fan inlet). It will be seen from this vector representation of the airflow that in the chamber upstream of the air inlet silencer, the airflow distribution is relatively uniform across the width and height of the unit and this give rise to a number of distinct advantages, some of which have already been mentioned above. In particular, with this air unit silencer, because the velocity of the air as it approaches the air inlet 52 is quite small, the velocity gradient of the airflow between the surfaces of the heat exchanging coils and the inlet silencer is also small and this results in uniformity of coil face velocity even though there may be a short distance between the final heat exchanging coils and the silencer inlet 52. Thus there is also uniform airflow across the heating and/or cooling coils located a short distance upstream of the inlet silencer. There is a lower pressure drop from one end of this air inlet silencer to the outlet end and no upstream wakes or flow distortions are generated by this air inlet silencer.

As already mentioned, in the preferred version of this air inlet silencer, sound cannot propagate directly in the axial direction from the fan blades to the air passageway directly upstream of the air inlet silencer. The arrangement and shape of the present air inlet silencer also causes the sound waves from the fan to be reflected several times so there is the opportunity for sound attenuation several times before the sound leaves the air inlet. Also, less materials and less labor are required to construct the air duct silencers of the present invention as compared to traditional splitter silencers (for example) and thus a preferred air silencer constructed in accordance with the invention can weigh less than a traditional splitter silencer. Also, it has been found that an air duct silencer constructed in accordance with the invention has very good, low frequency sound attenuation.

In one preferred embodiment of the present air duct silencer, the curved interior wall 56 and the curved side walls of the airflow defining member 60 are made of 20 gauge perforated, galvanized sheet metal.

With respect to the sound insulation, there can be two types of sound absorbing material used both behind the interior walls and in the airflow defining member 60. The first type of material is a relatively thin layer, for example, ½ inch of fiberglass insulation which has a cloth backing. A suitable form of this insulation is Knauf Ductliner-M, this material having zero erosion of the fiberglass insulation at air velocities up to 6,000 feet per minute. Because of this zero erosion characteristic, it is placed directly against the back of the perforated metal plate which forms the interior walls of the duct silencer with the cloth backing lying against the perforated sheet metal. Behind this material is placed standard low density acoustical filler which is used to fill the remainder of the cavity behind the interior walls and in the airflow defining member. This material can be standard fiberglass acoustical filler which can be purchased in the form of bats that are three inches thick and it is compressed to some extent in order that it will complete fill the space and have good sound absorbing capabilities.

It will be appreciated by those skilled in the air handling art that various modifications and changes can be made to the air duct inlet silencer as described herein without departing from the spirit and scope of this invention. Accordingly, all such modifications and changes as fall within the scope of the appended claims are intended to be part of this invention.

I claim:

1. An air duct silencing apparatus for use as an inlet silencing duct to be connected to an air supply fan unit for a building or other large structure, said apparatus comprising:

an exterior housing having exterior walls forming outer surfaces of said housing, an air inlet formed on one end of said housing, and a circular air outlet formed in an opposite end of said housing and adapted for connection to the fan unit for airflow to the fan unit, said outlet defining a primary central axis extending through the center of said outlet and perpendicular to a plane in which the outlet lies;

interior walls arranged in said housing, connected to said exterior walls and defining an annular airflow passageway extending from said air inlet to said air outlet, a substantial portion of said interior walls being made of perforated metal;

a central airflow defining member located in and further defining said annular airflow passageway and having a second central axis extending from an outer end thereof to an inner end adjacent said air outlet, said second central axis being substantially coaxial with said primary central axis, said airflow defining member being substantially circular in transverse cross-section along its length and having a relatively wide bulbiform end section at said outer end thereof and a relatively narrow end section at said inner end, and sound absorbing material in said housing and covered by said interior walls and also in said airflow defining member, wherein said airflow passageway tapers inwardly in the direction of said air outlet and the cross-sectional flow area of said annular airflow passageway varies along at least a substantial portion of its length so that airflow speed at said air inlet is low relative to airflow speed at said air outlet when said air duct silencing apparatus is connected to said fan unit and the fan unit is operating.

2. An air duct silencing apparatus according to claim 1 wherein said central airflow defining member projects outwardly from said air inlet.

3. An air duct silencing apparatus according to claim 2 wherein said airflow passage is tapered and said airflow defining member is curved as seen in axial planes extending through said second central axis so that the airflow speed increases smoothly to maximum velocity at said air outlet when the fan unit is operating.

4. An air duct silencing apparatus according to claim 2 wherein said air inlet in said one end of the housing is circular and has a diameter of approximately 2D and said air outlet has a diameter of approximately D.

5. An air duct silencing apparatus according to claim 4 wherein said central airflow defining member projects outwardly from said air inlet a distance equal to approximately ¼ D.

6. An air duct silencing apparatus according to claim 4 wherein said narrow end section is cylindrical and has a uniform diameter d and said outer end of the airflow defining member is flat and circular and has a diameter approximately equal to d.

7. In an air duct silencing apparatus adapted to be connected to an air supply fan unit, said apparatus having a housing with two opposite end walls, an air inlet formed in one of said end walls, and a smaller air outlet formed in the other end wall where said fan unit is located during use of said silencing apparatus, interior walls arranged in said housing and defining an annular, tapered airflow passageway extending from said air inlet to said air outlet, the improvement comprising an airflow defining member located centrally in said airflow passageway, extending the length of said airflow passageway, and having a substantially circular transverse cross-section, said airflow defining member having first and second longitudinal sections with said first longitudinal section being relatively wide with sidewalls that are curved along the length of the first longitudinal section in axial planes extending through a central longitudinal axis of the airflow defining member, said second longitudinal section being relatively narrow and cylindrical and located adjacent said air outlet, wherein the cross-sectional flow area of said annular airflow passageway varies along at least a substantial portion of its length so that airflow speed at said air inlet is low relative to airflow speed at said air outlet during use of the silencing apparatus.

8. An air duct silencing apparatus according to claim 7 wherein said first longitudinal section is substantially bulb-shaped and said airflow defining member is filled with sound absorbing material.

9. An air duct silencing apparatus according to claim 8 wherein longitudinally extending sidewalls of said airflow defining member are made of perforated sheet metal.

10. An air duct silencing apparatus according to claim 9 wherein said airflow defining member projects outwardly from said air inlet and in a direction away from said air outlet.

11. An air duct silencing apparatus according to claim 10 wherein said air inlet is circular and has a diameter of approximately 2D and said airflow defining member projects outwardly from said air inlet a distance equal to approximately ¼ D.

12. An air duct silencing apparatus according to claim 11 wherein said second longitudinal section has a diameter d and said airflow defining member has a substantially flat, circular outer end with a diameter approximately equal to d.

13. An air duct silencing apparatus according to claim 9 wherein said first longitudinal section has a maximum diameter which is slightly more than the diameter of said air outlet which is circular.

14. An air duct silencing apparatus according to claim 9 including a sound attenuating resonator at an end of said airflow defining member located at said air outlet, said resonator comprising a hollow chamber surrounded by a short cylindrical sidewall having a plurality of holes formed therein.

15. An air duct silencing apparatus according to claim 10 wherein said second longitudinal section has a length P and said airflow defining member projects outwardly from said air inlet and in a direction away from said air outlet a distance approximately equal to P.

* * * * *